US006815149B2

(12) United States Patent
Higashi et al.

(10) Patent No.: US 6,815,149 B2
(45) Date of Patent: Nov. 9, 2004

(54) PLASMA DISPLAY PANEL

(75) Inventors: Hirofumi Higashi, Yamanashi-ken (JP); Shingo Ogane, Yamanashi-ken (JP)

(73) Assignees: Pioneer Corporation, Tokyo (JP); Pioneer Display Products Corporation, Shizuoka (JP)

( * ) Notice: Subject to any disclaimer, the term of this patent is extended or adjusted under 35 U.S.C. 154(b) by 0 days.

(21) Appl. No.: 10/384,663

(22) Filed: Mar. 11, 2003

(65) Prior Publication Data

US 2003/0175614 A1 Sep. 18, 2003

(30) Foreign Application Priority Data

Mar. 13, 2002 (JP) ..... 2002-068149

(51) Int. Cl.[7] ..... H01J 11/00
(52) U.S. Cl. ..... 430/321; 445/24; 430/198
(58) Field of Search ..... 430/319, 321, 430/198, 257, 258; 445/24; 313/582, 584, 586

(56) References Cited

FOREIGN PATENT DOCUMENTS

JP 6-150824 A * 5/1994
JP 2001-174846 A * 1/2001

* cited by examiner

*Primary Examiner*—John A. McPherson
(74) *Attorney, Agent, or Firm*—Arent Fox, PLLC.

(57) ABSTRACT

Provision of a manufacturing method for forming lamination of a plurality of dielectric layers on a substrate of a plasma display panel. A forming process for forming a photosensitive glass material layer and a patterning process for exposing required regions of the resulting photosensitive glass material layer to light are repeated in each formation of a first photosensitive glass material layer L1 and a second photosensitive glass material layer L2. After completion of the individual forming process and the individual patterning process for each of the first and second photosensitive glass material layers L1 and L2, a developing process for removing the unexposed regions and a burning process following the developing process are each performed on both of the first and second photosensitive glass material layers L1 and L2 together.

8 Claims, 7 Drawing Sheets

PLASMA DISPLAY PANEL

BACKGROUND OF THE INVENTION

1. Field of the Invention

The invention relates to a method of manufacturing surface-discharge-scheme alternating-current-type plasma display panels, and more particularly, to a method of forming components, such as a dielectric layer and the like, of the plasma display panel.

The present application claims priority from Japanese Application No. 2002-68149, the disclosures of which are incorporated herein by reference for all purposes.

2. Description of the Related Art

At the present time, surface-discharge-type AC plasma display panels (hereinafter referred to as "PDP") have received attention as large-sized flat color-screen displays, and have increasingly become commonly used in ordinary homes.

FIGS. 6 and 7 illustrate the configuration of a surface-discharge-type alternating-current PDP which has been proposed by the present applicant. FIG. 6 is a schematically perspective view of the proposed PDP when the front glass substrate is disassembled from the back glass substrate. FIG. 7 is a sectional view taken along the column direction of the PDP at a central point in discharge cells.

The PDP in FIGS. 6 and 7 includes a front glass substrate 1 having a back surface on which a plurality of row electrode pairs (X, Y) are arranged at regular intervals in the column direction and each extends in the row direction. Each of the row electrodes X and Y forming the row electrode pair (X, Y) is constructed of T-shaped transparent electrodes Xa (Ya) and a bus electrode Xb (Yb) extending in the row direction. The transparent electrodes Xa and Ya are opposite to each other with a discharge gap g set at a required distance and interposed in between.

A dielectric layer 2 is also formed on the back surface of the front glass substrate 1 so as to cover the row electrode pairs (X, Y). In turn, additional dielectric layers 3 are formed on the back surface of the dielectric layer 2, and covered with a protective layer (not shown) made of MgO.

Further, a black additional layer 3A formed of a black light-absorbing material is formed on a portion of the additional dielectric layer 3 and opposite a zone between the bus electrodes Xb (Yb) of the back-to-back row electrodes X (Y).

On a surface of a back glass substrate 4 on the display screen side, a plurality of column electrodes D and a column electrode protective layer 5 covering the column electrodes D are formed, and then a partition wall 6 is formed on the column electrode protective layer 5.

The partition wall 6 is constructed of pairs of first transverse walls 6A, pairs of second transverse walls 6B and transverse walls 6C. The pairs of first transverse walls 6A and the pairs of second transverse walls 6B are arranged in alternate positions in the column direction. The first or second transverse walls 6A or 6B in each pair are positioned back to back in between adjacent display lines.

A clearance r is formed between the second transverse wall 6B and the protective layer covering the additional dielectric layer 3.

The opposing first transverse walls 6A, the opposing second transverse walls 6B and the vertical walls 6C of the partition wall 6 partition the discharge space defined between the front glass substrate 1 and the back glass substrate 4 into display discharge cells C1. Red-, green-, and blue-colored phosphor layers 7 are each formed in the display discharge cell C1 and are arranged in order in the row direction.

Further, a protrusion rib 8 protrudes into a space formed between the two back-to-back second transverse walls 6B and raises a part of the column electrode D, located between the two second transverse walls 6B, and the column electrode protective layer 5 covering this column electrode D, to cause them to be in contact with the black additional layer 3A.

Thus, two addressing discharge cells C2 are formed on both sides of the protrusion rib 8, and each communicates with the corresponding display discharge cells C1 through the clearances r.

When additional layers of a dielectric layer are formed in multilayer formation as in the case of the above PDP, a lamination of the additional layers (for example, the additional dielectric layer 3 and the black additional layer 3A) on the dielectric layer is carried out by prior art methods typically including the following steps.

A prior art method using a photosensitive dielectric film for forming the lamination of the additional layers of the dielectric layer is here described.

Initially, as illustrated in FIG. 8A, a photosensitive dielectric film F1 is laminated on the dielectric layer 2 of the glass substrate 1 on which the row electrodes (not shown) and the dielectric layer 2 are formed. Then, as illustrated in FIG. 8B, a mask M1 having through-holes M1*a* formed therein in correspondence with positions and shape of additional dielectric layers 3 to be formed is laid on the photosensitive dielectric film F1. The photosensitive dielectric film F1 is exposed to light through the mask M1 to undergo patterning.

Then, as illustrated in FIG. 8C, the photosensitive dielectric film F1 is developed to remove the unexposed regions, and then the remaining exposed regions are burned to form additional dielectric layers 3.

Then, as illustrated in FIG. 8D, a photosensitive dielectric film F2 is laminated on the dielectric layer 2 and the additional dielectric layers 3 which is formed as described.

Then, similarly, as illustrated in FIG. 8E, a mask M2 having through-holes M2*a* formed therein in correspondence with positions and shape of additional dielectric layers 3A to be formed is laid on the photosensitive dielectric film F2. The photosensitive dielectric film F2 is exposed to light through the mask M2 to undergo patterning.

After this patterning process, as illustrated in FIG. 8F, the photosensitive dielectric film F2 is developed to remove the unexposed regions, and then the remaining exposed regions are burned to form additional dielectric layers 3A.

However, in the case of the above prior art method using a photosensitive dielectric layer for forming the additional layers of the dielectric layer in multilayer form, when the photosensitive dielectric film F2 is laminated in order to form the additional dielectric layers 3A which is the second layer, protrusions and hollows presented by the pre-formed additional dielectric layers 3 cause crinkles in the photosensitive dielectric film F2, and therefore adhesion between the photosensitive dielectric film F2 and the dielectric layer 2 is insufficient, giving rise to a problem of peeling in the developing or burning process.

Further, with this prior art method, the initially formed additional dielectric layers 3 are shrunk in shape in the burning process. This shrinkage results in the strict necessity for high precision in alignment in the patterning process for the second layer for the additional dielectric layers 3A. The uneven top surfaces of the additional dielectric layers 3 after undergoing the burning process gives rise to a problem of the sliding of the photosensitive dielectric film F2 during the developing process for forming the second layer for the additional dielectric layers 3A.

The prior art method has further problems of an increase in manufacturing costs and a decrease in efficiency of working because of the increase in manufacturing steps due to repeating the exposure, development and burning processes for forming the first layer and the second layer which are to be the additional layers of the dielectric layer.

The prior art method has yet another problem of a relatively positional deviation produced between the pattern of the row electrode and the additional layers of the dielectric layer because the repeating of the burning processes creates deformation or shrinkage of the glass substrate 1.

Another prior art method using pattern printing for multilayer formation of additional layers of the dielectric layer is now described. First, as illustrated in FIG. 9A, a low-melting glass paste 3' is pattern-printed and dried onto a predetermined position on the dielectric layer 2 of the glass substrate 1 on which the row electrodes (not shown) and the dielectric layer 2 are formed, so as to be shaped in correspondence with the shape of the additional dielectric layer to be formed.

In addition, as illustrated in FIG. 9B, another low-melting glass paste 3A' is pattern-printed and dried onto a predetermined position on the pattern-printed and dried low-melting glass paste 3' so as to be shaped in correspondence with the shape of the additional dielectric layer to be formed.

After that, the low-melting glass pastes 3' and 3A' formed in double-layer formation are burned to form two laminated additional dielectric layers.

However, the above prior art method using pattern printing also has problems of the difficulty in alignment between the additional layers of the dielectric layer in multilayer formation because of the low precision of pattern printing, and also of the likelihood of low precision in the multilayer dimensions of the formed additional dielectric layers because of wide variations in film-thickness of the low-melting glass paste 3' and 3A' formed by pattern printing.

SUMMARY OF THE INVENTION

The present invention has been made to solve the various problems arising in the prior art processes of multilayer lamination of additional layers of a dielectric layer in plasma display panels as described above.

It is therefore an object of the present invention to provide a method of manufacturing plasma display panels capable of forming and laminating dielectric layers in multilayer formation with a reduced number of processes and also providing a high precision.

To attain the above object, a manufacturing method of plasma display panels according to the present invention relates to a manufacturing method for forming lamination of a plurality of dielectric layers on a substrate of the plasma display panel, having a first feature of including the steps of: a forming process for forming a photosensitive glass material layer forming the dielectric layers; a patterning process for exposing required parts of the photosensitive glass material layer, formed by the forming process, to light; repeating the forming process and the patterning process for each of the photosensitive glass material layers to be formed and laminated on the substrate; a developing process for concurrently removing unexposed parts from all of the formed and laminated photosensitive glass material layers after completion of the forming process and the patterning process for each photosensitive glass material layer; and a burning process for concurrently burning all of the formed and laminated photosensitive glass material layers having been subjected to the developing process.

With the manufacturing method for plasma display panels according to the first feature, for example, when additional layers of a dielectric layer covering discharge electrodes formed on a substrate of the plasma display panel are laminated in multilayer form on the dielectric layer in order to limit the spreading of a discharge, the forming process for a photosensitive glass material layer, and the patterning process for exposing to light the photosensitive glass material layer, formed in the forming process, to pattern it with dielectric layers of a required shape at required positions are repeatedly performed on each of the photosensitive glass material layers for multilayer formation of the dielectric layers to be laminated.

After all of the required photosensitive glass material layers have been formed, and the patterning performed thereon, the laminated photosensitive glass material layers all undergo at the same time the developing process for removing the parts of the photosensitive glass material layer unexposed in the patterning process so that the remaining exposed parts will form dielectric layers such as the additional layers having the required shape, and undergo the burning process for solidifying the photosensitive glass material layers provided by the developing process.

As described above, according to the first feature, the developing process is performed concurrently on all of the photosensitive glass material layers after completion of the forming process for each of the multilayered photosensitive glass material layers. Hence, each of the second and later photosensitive glass material layers is formed on a photosensitive glass material layer that has not experienced the developing process. The resulting flat formation of the top surface of the photosensitive glass material layer leads to a significant increase in the positional precision between the dielectric layers to be laminated in multilayer form, as compared with the prior art manufacturing methods.

The burning process is finally performed concurrently on the photosensitive glass material layers. The photosensitive glass material layers are not burned repeatedly as was done in prior art methods, to prevent an inferior precision in alignment and the occurrence of positional deviation between the electrodes formed on the substrate and the dielectric layers laminated in multilayer form.

Further, the developing process and the burning process are each performed only one time, leading to simplification of the manufacturing process of the plasma display panel, and naturally reduction in the manufacturing cost.

To attain the aforementioned object, the manufacturing method for plasma display panels has, in addition to the configuration of the first feature, a second feature that the photosensitive glass material layer is formed of glass materials having lead oxide and silicon dioxide as their main components, and glass materials including photosensitive resin made from an acrylic-type monomer or oligomer.

To attain the aforementioned object, the manufacturing method for plasma display panels has, in addition to the configuration of the first feature, a third feature that the photosensitive glass material layer is burned at temperatures in the vicinity of a softening point of the glass materials forming the photosensitive glass material layer.

To attain the aforementioned object, the manufacturing method for plasma display panels has, in addition to the configuration of the third feature, a fourth feature that the burning temperature ranges from 560 degrees C. to 580 degrees C.

To attain the aforementioned object, the manufacturing method for plasma display panels has, in addition to the configuration of the first feature, a fifth feature that a non-photosensitive glass material layer is formed on the substrate prior to the forming of the initial layer of the photosensitive glass material layers, and undergoes the burning process concurrently with the laminated photosensitive glass material layers.

With the manufacturing method for plasma display panels according to the fifth feature, the non-photosensitive glass material layer forming the dielectric layer covering the electrodes formed on the substrate, is formed on the substrate prior to the forming of the photosensitive glass material layers to be laminated in multilayer form. Then the burning process for the non-photosensitive glass material layer is performed concurrently with the burning process for the laminated photosensitive glass material layers.

Therefore, positional deviation between the dielectric layers after their formation is prevented and simplification of the manufacturing process to reduce the manufacturing costs is provided.

To attain the aforementioned object, the manufacturing method for plasma display panels has, in addition to the configuration of the fifth feature, a sixth feature that the non-photosensitive glass material layer is formed of glass materials having lead oxide and silicon dioxide having softening point temperatures of about 560 degrees C. as their main components, and glass materials including non-photosensitive resin made from an acrylic-type polymer.

To attain the aforementioned object, the manufacturing method for plasma display panels has, in addition to the configuration of the fifth feature, a seventh feature that the non-photosensitive glass material layer and the photosensitive glass material layer are formed of the glass materials approximately equal to each other in softening point temperatures.

With the manufacturing method for plasma display panels according to the seventh feature, the use of glass materials roughly equal in softening point temperature to form the non-photosensitive and photosensitive glass material layers allows the burning process to be performed concurrently on the non-photosensitive and photosensitive glass material layers.

To attain the aforementioned object, the manufacturing method for plasma display panels has, in addition to the configuration of the fifth feature, an eighth feature that the dielectric layer provided by the photosensitive glass material layer is an additional layer of the dielectric layer provided by the non-photosensitive glass material layer.

With the manufacturing method of plasma display panels according to the eighth feature, at required positions on the dielectric layer provided by the non-photosensitive glass material layer, the photosensitive glass material layer forms the additional layers of required dimensions allowing for limitation of the spreading of a discharge in the discharge space, or the like.

To attain the aforementioned object, the manufacturing method for plasma display panel has, in addition to the configuration of the first feature, a ninth feature that the formation of the photosensitive glass material layer on the substrate in the forming process is carried out by pre-coating of a glass paste on a supporting film and then bonding of the resulting photosensitive glass material layer onto the substrate by pressure.

With the manufacturing method for plasma display panels according to the ninth feature, in order to form the photosensitive glass material layer on the substrate, a glass paste is not coated directly on the substrate, and alternatively the glass paste is previously coated on the supporting film and dried thereon to prepare a film having a photosensitive glass layer with a required thickness formed thereon. The film-form photosensitive glass material layer is bonded by pressure while the supplying film is being peeled from it, to form a photosensitive glass material layer on the substrate.

As a result, the manufacturing process of the plasma display panels is simplified and the photosensitive glass material layer has an advantage of being formed to a desired and uniform thickness on the substrate.

To attain the aforementioned object, the manufacturing method for plasma display panels has, in addition to the configuration of the ninth feature, a tenth feature that while the supporting film is peeled from the photosensitive glass material layer formed on the supporting film, the photosensitive glass material layer is bonded on the substrate by pressure in a heated state by use of a roller.

To attain the aforementioned object, the manufacturing method for plasma display panels has, in addition to the configuration of the first feature, an eleventh feature that in the patterning process, each of the photosensitive glass material layers is exposed to light through a mask having through-holes corresponding to positions and shape of the dielectric layers provided by the photosensitive glass material layer.

With the manufacturing method for plasma display panels according to the eleventh feature, for each of the dielectric layers to be laminated in multilayer form, a mask having the through-holes corresponding to the positions and shape of the individual dielectric layer can be prepared in advance or alternatively can be formed on the corresponding photosensitive glass material layer. Each photosensitive glass material layer is exposed to light through the corresponding mask in the patterning process in order to be readily laminated as a dielectric layer of a desired shape in a desired position.

These and other objects and features of the present invention will become more apparent from the following detailed description with reference to the accompanying drawings.

DETAILED DESCRIPTION OF THE PREFERRED EMBODIMENT

One of preferred embodiments according to the present invention will be described hereinafter in detail with reference to the accompanying drawings.

FIG. 1 to FIG. 5 are diagrams illustrating a manufacturing method for plasma display panels (hereinafter referred to as "PDP") in an embodiment according to the present invention.

In the manufacturing method for PDP in the embodiment, first, row electrodes (not shown) and a non-photosensitive glass material layer L0 are formed on a glass substrate 10.

If the glass substrate 10 is a front glass substrate situated on the display screen side of the PDP, the row electrodes are formed such that a transparent conductive film made of ITO or the like is evaporated onto the glass substrate 10, and then is patterned with a letter-T shape by using photolithography techniques. Next, a photosensitive silver paste is so coated as to be connected with base ends of the T-shaped transparent conductive films, then is dried, and then is patterned with a band shape by use of photolithography techniques.

The non-photosensitive glass material layer L0 is formed of non-photosensitive glass materials, and in such a manner that a low-melting glass paste including glass materials having lead oxide and silicon dioxide of softening-point temperatures of about 560 degrees C. as their main components, and non-photosensitive resin made from an acrylic-type polymer, is coated on the surface of the glass substrate 10 having the row electrodes formed thereon, and then dried.

Figure 1:
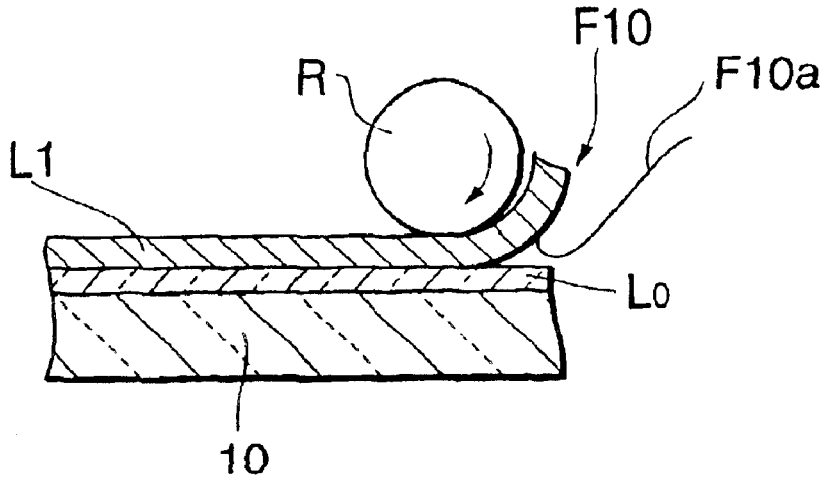
FIG. 1 is a diagram illustrating a forming process for a photosensitive glass material layer in accordance with the present invention.

Next, as illustrated in FIG. 1, while a base film F10*a* is being peeled from a photosensitive resin film F10, the photosensitive resin film F10 is bonded onto the non-photosensitive glass material layer L0, formed on the glass substrate 10, in a heated state by use of a roller R to form a first photosensitive glass material layer L1.

To fabricate the photosensitive resin film F10 forming the first photosensitive glass material layer L1, a low-melting glass paste including glass materials having lead oxide and silicon dioxide as their main components, and photosensitive resin made from an acrylic-type monomer or oligomer, and having a softening point temperature roughly equal to that of the glass materials for forming the non-sensitive glass material layer L0, is coated on the base film F10*a* and then dried.

Figure 2:
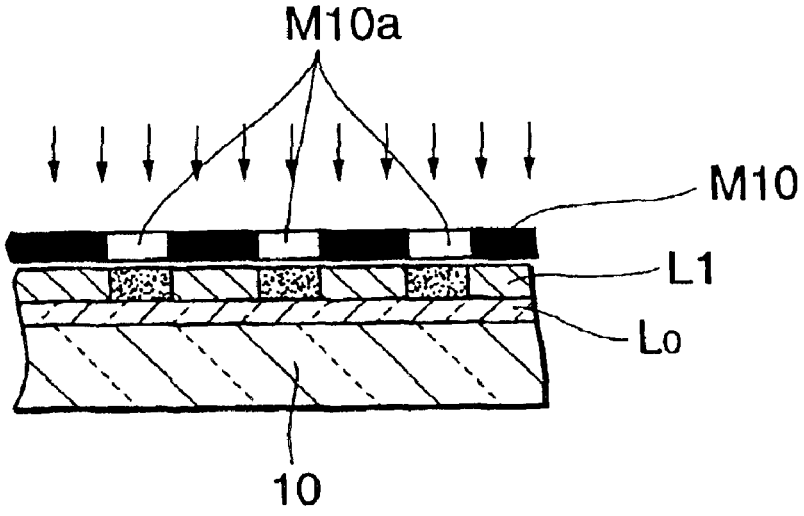
FIG. 2 is a diagram illustrating a patterning process.

Next, as illustrated in FIG. 2, the first photosensitive glass material layer L1 formed on the glass substrate 10 is exposed to light through a resist mask M10 having through-holes M10*a* of a required shape formed therein in required positions, to be patterned.

To form the resist mask M10, a film-form resist is laminated on the first photosensitive glass material layer L1, and then the resists is exposed to light and developed by use of a mask having a predetermined pattern in order that the through-holes M10*a* are opened in positions of the resist corresponding to where first additional layers of the dielectric layer are to be formed, and each has a shape identical with the outline of the first additional layer.

In this manner, following the completion of the patterning process for the first photosensitive glass material layer L1, the resist mask M10 is peeled from the first photosensitive glass material layer L1.

Figure 3:
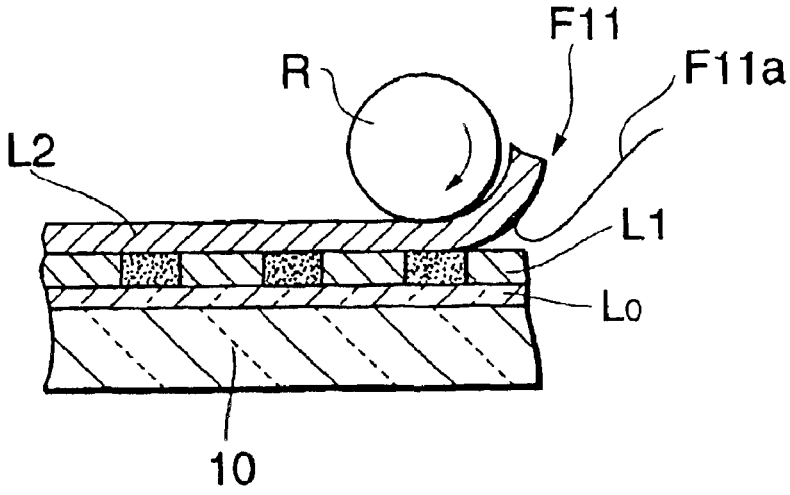
FIG. 3 is a diagram illustrating a forming process when another photosensitive glass material layer is formed for lamination.

As illustrated in FIG. 3, then, as in the case of the photosensitive resin film F10, while a base film F11*a* is being peeled from a photosensitive resin film F11, the photosensitive resin film F11 is bonded on the first photosensitive glass material layer L1, undergone the patterning process, in a heated state by the use of roller R to form a second photosensitive glass material layer L2.

To make the photosensitive resin film F11, a low-melting glass paste having approximately the same softening point temperature and approximately the same components as those of the photosensitive resin film F10 used for forming the first photosensitive glass material layer L1 is coated on the base film F11*a* and dried.

Figure 4:
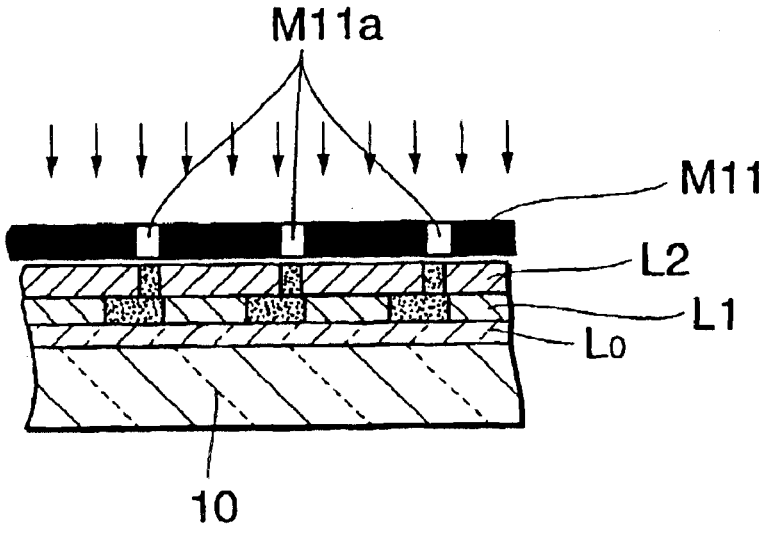
FIG. 4 is a diagram illustrating a patterning process for the photosensitive glass material layer formed and laminated.

Then, as illustrated in FIG. 4, as in the case of the formation of the first photosensitive glass material layer L1, the second photosensitive glass material layer L2 is exposed to light through a resist mask M11 formed on the second photosensitive glass material layer L2 and having through-holes M11*a* opened in positions therein corresponding to positions where second additional layers of the dielectric layer are to be formed, and each having a shape identical with the outline of the second additional layer, to be patterned.

Following the completion of the patterning process for the second photosensitive glass material layer L2, the resist mask M11 is peeled from the second photosensitive glass material layer L2.

Figure 5:
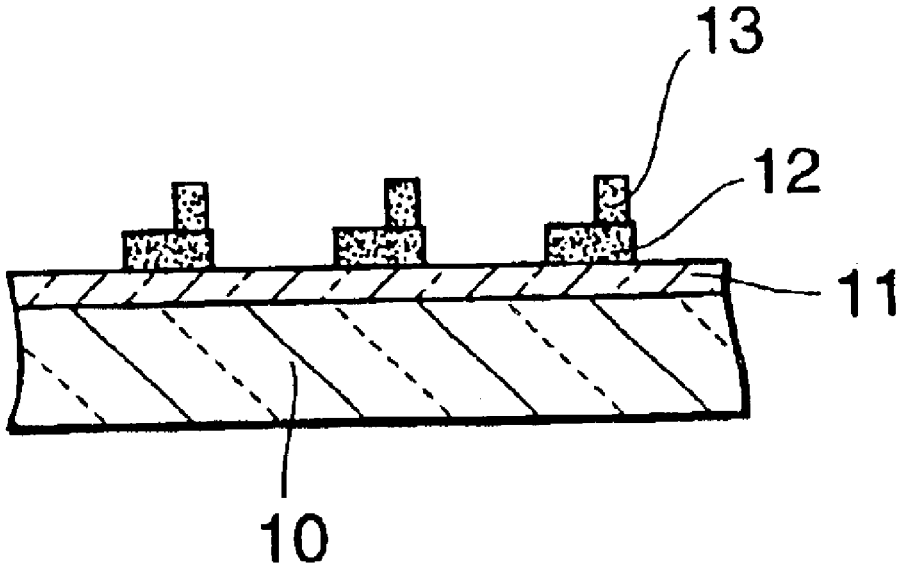
FIG. 5 is a diagram illustrating a developing process and a burning process.
Figure 6:
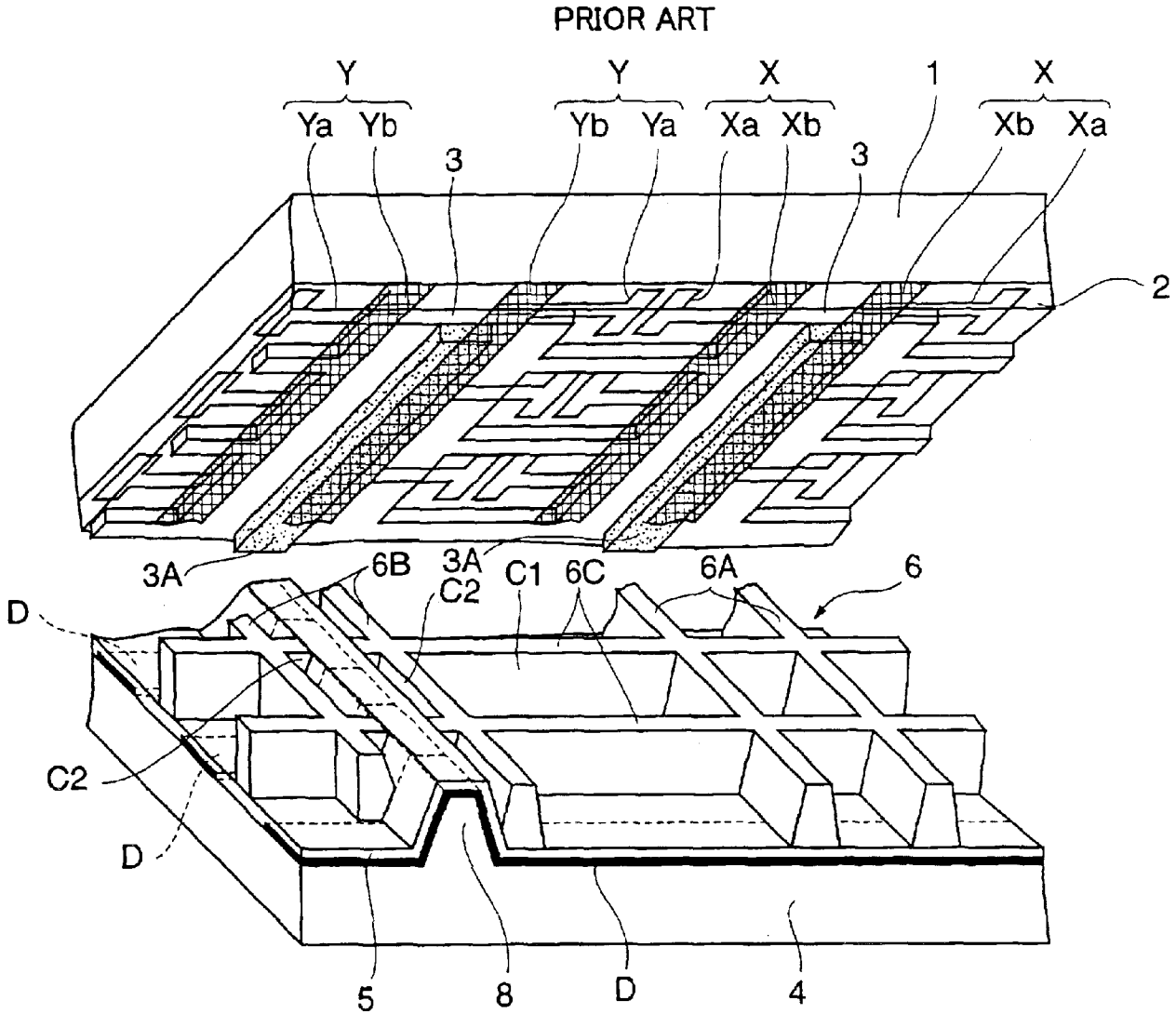
FIG. 6 is a perspective view illustrating an example of plasma display panels having dielectric layers formed therein in multilayer form.
Figure 7:
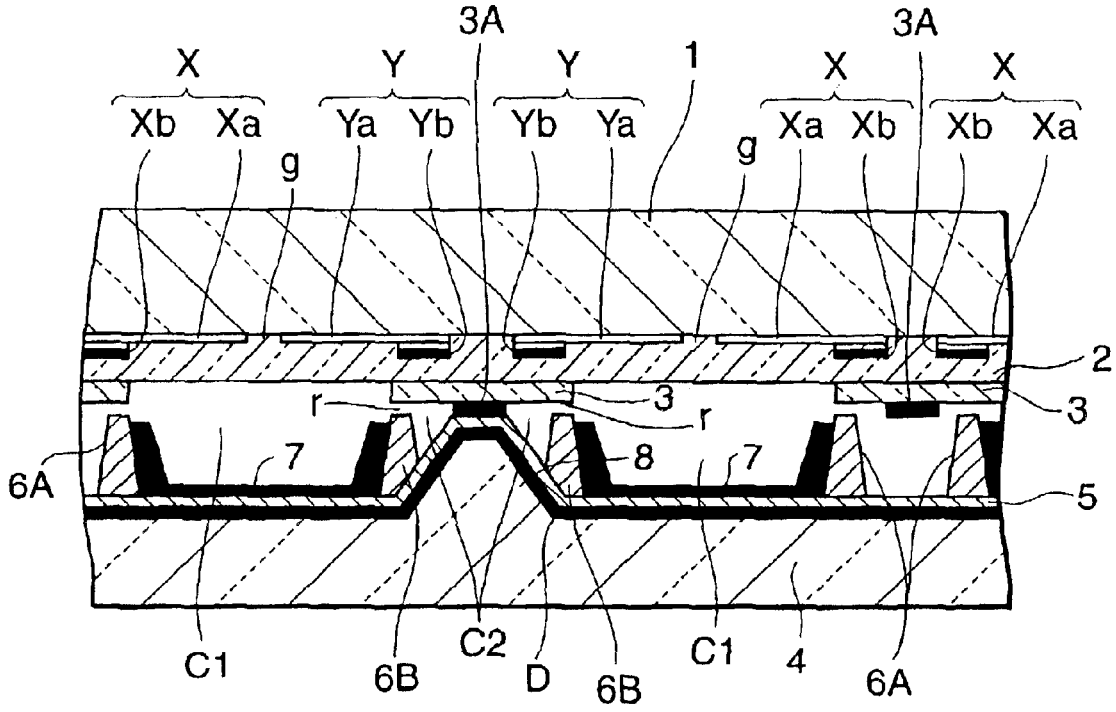
FIG.7 PRIOR ART
FIG. 7 is a vertically sectional view of the plasma display panel in FIG. 6.
Figure 8A:
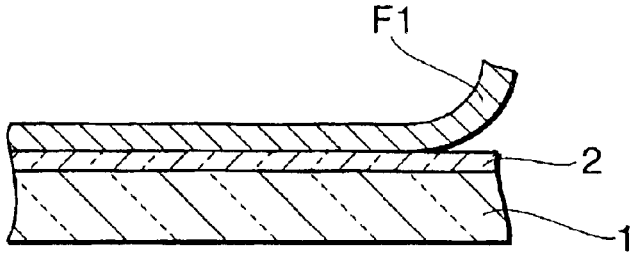
PRIOR ART FIG.8 A
FIG. 8A is a diagram illustrating a first process in an example of prior art manufacturing methods for plasma display panels.
Figure 8B:
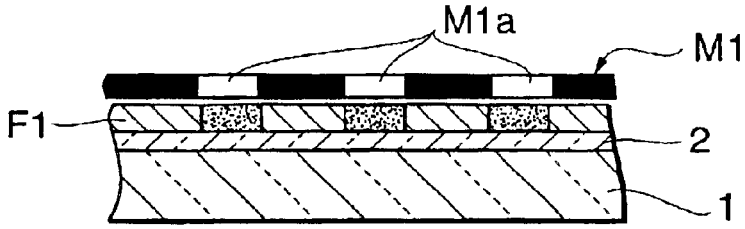
FIG. 8B is a diagram illustrating a second process in the example of the prior art manufacturing methods.
Figure 8C:
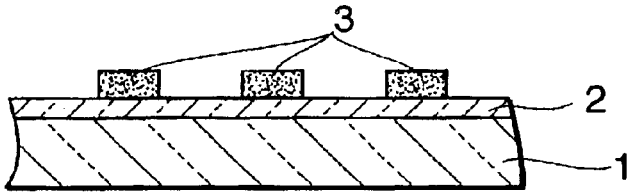
FIG. 8C is a diagram illustrating a third process in the example of the prior art manufacturing methods.
Figure 8D:
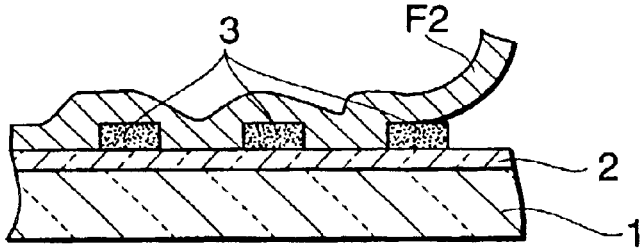
FIG. 8D is a diagram illustrating a fourth process in the example of the prior art manufacturing methods.
Figure 8E:
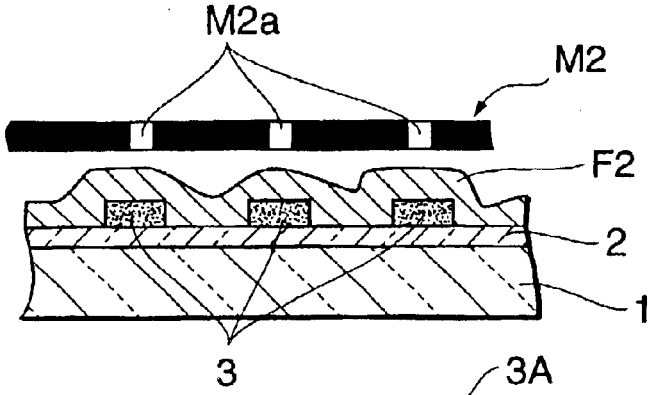
FIG. 8E is a diagram illustrating a fifth process in the example of the prior art manufacturing methods.
Figure 8F:
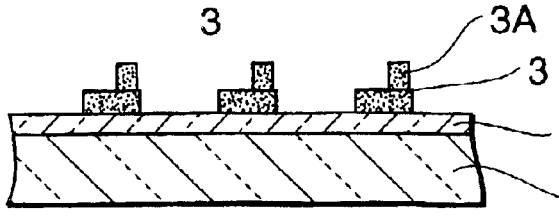
FIG. 8F is a diagram illustrating a sixth process in the example of the prior art manufacturing methods.
Figure 9A:
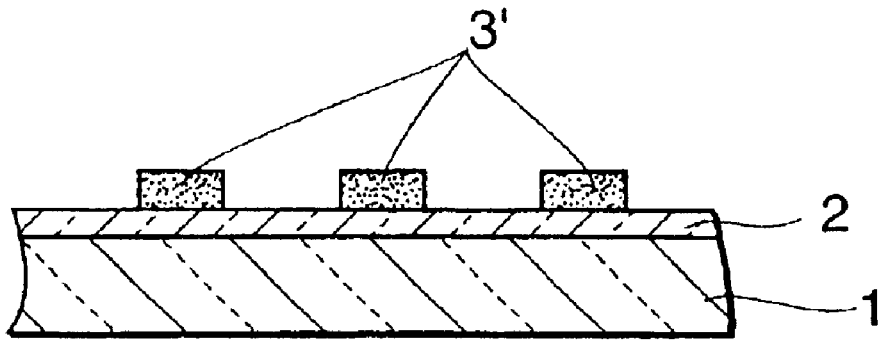
FIG.9 A PRIOR ART
FIG. 9A is a diagram illustrating a first process in another example of prior art manufacturing methods for plasma display panels.
Figure 9B:
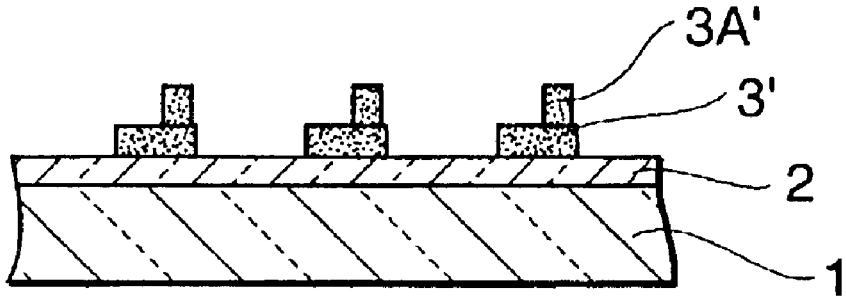
FIG.9 B PRIOR ART
FIG. 9B is a diagram illustrating a second process in the alternative example of the prior art manufacturing methods.

Then, as illustrated in FIG. 5, the first photosensitive glass material layer L1 and the second photosensitive glass material layer L2 each undergone the patterning process as described above are developed at the same time.

Then, the first photosensitive glass material layer L1, the second photosensitive glass material layer L2, and the non-photosensitive glass material layer L0 all of which undergone the developing process are concurrently burned at a temperature (e.g. from about 560 to 580 degrees C.) in the vicinity of their softening points. Hence, the non-photosensitive glass material layer L0 forms a dielectric layer 11, the first photosensitive glass material layer L1 forms a first additional dielectric layer 12, and the second photosensitive glass material layer L2 forms a second additional dielectric layer 13.

As described above, with the foregoing manufacturing method, after the patterning process for and before the developing process for the first photosensitive glass material layer L1, the forming process and the patterning process are performed on the second photosensitive glass material layer L2. After that, the developing process is performed concurrently on the first photosensitive glass material layer L1 and the second photosensitive glass material layer L2. Because of these steps, the first photosensitive glass material layer L1 has a flat surface when the second photosensitive glass material layer L2 is formed thereon. For this reason, a significantly high positional precision between the additional dielectric layer 12 and the additional dielectric layer 13 which are to be formed is provided as compared with that in prior art manufacturing methods.

Further, all of the non-photosensitive glass material layer L0 and the first and second photosensitive material layer L1 and L2 are finally burned at the same time. This prevents an inferior precision in alignment and the occurrence of positional deviation among the row electrodes, the additional dielectric layer 12, and the additional dielectric layer 13, which are produced by repeating the burning processes as in the prior art manufacturing methods.

Further, the developing process and the burning process are each performed only one time, leading to simplification of the manufacturing process to reduce in the manufacturing cost.

In the above-mentioned manufacturing method, to form the non-photosensitive glass material layer L0, a low-melting glass paste including glass materials having lead oxide and silicon dioxide having a softening-point temperature of about 560 degrees C. as their main components, and non-photosensitive resin made from an acrylic-type polymer may be coated on a base film and dried. The resulting non-photosensitive glass material layer may be bonded on the glass substrate 10 by pressure.

The non-photosensitive glass material layer L0 formed by using the film-form non-photosensitive glass material layer as described above may be burned together with the first and second photosensitive glass material layers L1 and L2.

In the embodiment, each of the first photosensitive glass material layer L1 and the second photosensitive glass material layer L2 is patterned by use of the dedicated mask formed of resist film which is exposed to light for patterning and then developed. However, each patterning process may use a mask having required through-holes pre-formed therein.

The first and second photosensitive glass material layers in the embodiment is a negative type, so that their unexposed regions are removed by the developing process.

In the embodiment, the formation of the dielectric layer 11 uniformly covering the inner surface of the glass substrate 10 and the row electrodes is carried out by coating and burning of the non-photosensitive glass material layer, but the dielectric layer may be formed of a negative-type photosensitive glass material layer.

In this case, after the formation of the photosensitive glass material layer, the full surface of the photosensitive glass material layer is exposed to light.

Then, the developing process and the burning process for the photosensitive glass material layer forming the dielectric layer 11 may be respectively performed simultaneously with the developing process and the burning process for the first and second photosensitive glass material layers.

Still further, the embodiment describes the manufacturing method of using a photosensitive resin film to form the first and second photosensitive glass material layers. However, the formation of each of the first and second photosensitive glass material layers may be carried out by coating of a photosensitive glass paste by use of printing techniques, roll-coating techniques, or the like.

The terms and description used herein are set forth by way of illustration only and are not meant as limitations. Those skilled in the art will recognize that numerous variations are possible within the spirit and scope of the invention as defined in the following claims.

What is claimed is:

1. A manufacturing method of plasma display panels for forming lamination of a plurality of dielectric layers on a substrate of the plasma display panel, comprising the steps of:

a forming process for forming a non-photosensitive glass material layer forming the dielectric layers on the substrate;

a forming process for forming a photosensitive glass material layer forming the dielectric layers and providing an additional layer on the non-photosensitive glass material layer;

a patterning process for exposing required parts of the photosensitive glass material layer formed by the forming process to light;

repeating the forming process for forming the photosensitive glass material layer and the patterning process for each of the photosensitive glass material layers to be formed and laminated on the non-photosensitive glass material layer by using masks each having different shape through-holes to each other, a developing process for concurrently removing unexposed parts from all of the formed and laminated photosensitive glass material layers after completion of the forming process and the patterning process for all photosensitive glass material layers; and a burning process for concurrently burning the non-photosensitive glass material layer and all of the formed and laminated photosensitive glass material layers having been subjected to the developing process, wherein said non-photosensitive glass material layer and said photosensitive glass material layer are formed of the glass materials approximately equal to each other in softening point temperatures.

2. A manufacturing method for plasma display panels according to claim 1, wherein said photosensitive glass material layer is formed of glass materials having lead oxide and silicon dioxide as their main components, and glass materials including photosensitive resin made from an acrylic-type monomer or oligomer.

3. A manufacturing method for plasma display panels according to claim 1, wherein said photosensitive glass material layer is burned at temperatures in the vicinity of a softening point of the glass materials forming the photosensitive glass material layer.

4. A manufacturing method for plasma display panels according to claim 3, wherein said burning temperature ranges from 560 degrees C. to 580 degrees C.

5. A manufacturing method for plasma display panels according to claim 5, wherein said non-photosensitive glass material layer is formed of glass materials having lead oxide and silicon dioxide having softening point temperatures of about 560 degrees C. as their main components, and glass materials including non-photosensitive resin made from an acrylic-type polymer.

6. A manufacturing method for plasma display panel according to claim 1, wherein the formation of said photosensitive glass material layer on the substrate in said forming process is carried out by pre-coating of a glass paste on a supporting film and then bonding of the resulting photosensitive glass material layer onto the substrate by pressure.

7. A manufacturing method for plasma display panels according to claim 6, wherein while the supporting film is peeled from said photosensitive glass material layer formed on the supporting film, the photosensitive glass material layer is bonded on the substrate by pressure in a heated state by use of a roller.

8. A manufacturing method for plasma display panels according to claim 1, wherein in said patterning process, each of said photosensitive glass material layers is exposed to light through a mask having through-holes corresponding to positions and shape of the dielectric layers provided by the photosensitive glass material layer.

* * * * *